United States Patent [19]

Tsutsumi et al.

[11] 4,364,345

[45] Dec. 21, 1982

[54] SPLIT TYPE INTERNAL COMBUSTION ENGINE

[75] Inventors: Saburo Tsutsumi, Yokohama; Yasuhiko Nakagawa, Kamakura, both of Japan

[73] Assignee: Nissan Motor Company, Limited, Kanagawa, Japan

[21] Appl. No.: 215,081

[22] Filed: Dec. 10, 1980

[30] Foreign Application Priority Data

Dec. 12, 1979 [JP] Japan ..... 54-161085

[51] Int. Cl.[3] ..... F02D 17/02

[52] U.S. Cl. ..... 123/198 F; 123/90.1

[58] Field of Search ..... 123/198 F, 90.1

[56] References Cited

U.S. PATENT DOCUMENTS

| | | | |
|---|---|---|---|
| 4,198,940 | 4/1980 | Ishida | 123/198 F |
| 4,201,180 | 5/1980 | Iizuka | 123/198 F |
| 4,231,338 | 11/1980 | Sugasawa et al. | 123/198 F |

*Primary Examiner*—Ira S. Lazarus

*Attorney, Agent, or Firm*—Schwartz, Jeffery, Schwaab, Mack, Blumenthal & Koch

[57] ABSTRACT

An internal combustion engine is disclosed which includes a first cylinder unit always active and a second cylinder unit inactive when the engine load is below a given value. Means is provided for operating the intake and exhaust valve means associated with the first cylinder unit with relatively small valve overlap and operating the intake and exhaust valve means associated with the second cylinder unit with relatively large valve overlap.

3 Claims, 4 Drawing Figures

SPLIT TYPE INTERNAL COMBUSTION ENGINE

BACKGROUND OF THE INVENTION

1. Field of the Invention

This invention relates to improvements in an internal combustion engine of the split type operable on less than all of its cylinders when the engine load is below a given value.

2. Description of the Prior Art

It is known and desirable to increase the efficiency of a multicylinder internal combustion engine by reducing the number of cylinders on which the engine operates under predetermined engine operating conditions, particularly conditions of low engine load. Control systems have already been proposed which disable a number of cylinders in a multicylinder internal combustion engine by suppressing the supply of fuel to certain cylinders or by preventing the operation of the intake and exhaust valves of selected cylinders. Under given engine load conditions, the disablement of some of the cylinders of the engine increases the load on those remaining in operation and, as a result, the energy conversion efficiency is increased.

As compared to normal internal combustion engines operating on all of the cylinders over the full range of engine load conditions, stable combustion is more essential for split type internal combustion engines adapted to operate on less than all of the cylinders under low engine load conditions. It is common practice in the field of split type internal combustion engines to equalize the number of cylinders disabled under low engine load conditions to the number of cylinders remaining in operation over the full range of engine load conditions. For example, six-cylinder, split-type internal combustion engines have been designed to have three cylinders disabled under low engine load conditions.

It is desirable to design the cylinders held active over the full range of engine load conditions to ensure stable operation under low speed and light load conditions and the cylinders disabled under low load conditions to achieve sufficient output power under high speed and high load conditions.

The present invention provides an improved split type internal combustion engine which can ensure stable operation under low load conditions and achieve sufficient output power under high load conditions.

SUMMARY OF THE INVENTION

In accordance with the present invention, there is provided an internal combustion engine which includes first and second cylinder units each having at least one cylinder, first intake and exhaust valve means associated with the first cylinder unit, second intake and exhaust valve means associated with the second cylinder unit, and means for disabling the second cylinder unit when the engine load is below a predetermined value. First valve operating means is provided for operating the first intake and exhaust valve means with a first amount of valve overlap. Second valve operating means operates the second intake and exhaust valve means with a second amount of valve overlap relatively larger than the first valve overlap amount. The first valve overlap amount may be in the range of about −10° to 20° preferably about 0 to 10°. The second valve overlap amount may be in the range of about 20° to 80° preferably about 30° to 40°.

BRIEF DESCRIPTION OF THE DRAWINGS

The present invention will be described in greater detail by reference to the following description taken in connection with the accompanying drawings, in which.

DESCRIPTION OF THE PREFERRED EMBODIMENT

Figure 1:
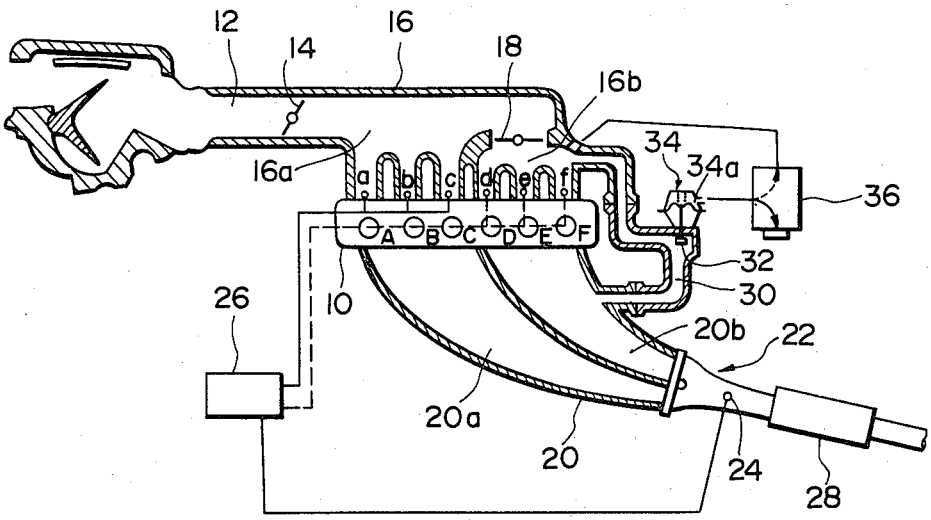
FIG. 1 is a schematic sectional view showing one embodiment of a split type internal combustion engine constructed in accordance with the present invention.

Referring now to FIG. 1, there is illustrated one embodiment of a split type internal combustion engine made in accordance with the present invention. The engine comprises an engine block 10 which contains a first cylinder unit shown as including three cylinders A, B and C being always active, and a second cylinder unit shown as including three cylinders D, E and F being incative when the engine load is below a predetermined value. Air is supplied to the engine through an induction passage 12 provided therein with a throttle valve 14 drivingly connected to the accelerator pedal (not shown) for controlling the flow of air to the engine. The induction passage 12 is connected downstream of the throttle valve 14 to an intake manifold 16 which has first and second separate intake passages **16*a* and 16*b*. The first intake passage 16*a* leads to the first cylinder unit, and the second intake passage 16*b* leads to the second cylinder unit. The second intake passage 16*b* is provided at its entrance with a stop valve 18** adapted to close so as to block the flow of fresh air to the second cylinder unit under low load conditions.

The reference numeral 20 designates an exhaust manifold having first and second separate exhaust passages **20*a* and 20*b*. The first exhaust passages 20*a* leads from the first cylinder unit, and the second exhaust passage 20*b* leads from the second cylinder unit. The exhaust manifold is connected at its downstream end to an exhaust duct 22 provided therein with an exhaust gas sensor 24**.

The exhaust gas sensor 24 may be in the form of an oxygen sensor which monitors the oxygen content of the exhaust and provides a feedback signal indicative of the air/fuel ratio at which the engine is operating. The feedback signal is fed from the exhaust gas sensor 24 to a control circuit 26 which thereby controls the operation of the fuel injection valves a to f for the respective cylinders A to F to ensure that the fuel supplied to the engine is correct to maintain a desired optimum air/fuel ratio. The control circuit 26 has an additional function of closing the fuel injection valves d, e and f to shut off the supply of fuel to the associated cylinders D, E and F under low load conditions.

An exhaust gas purifier 28 is provided in the exhaust duct 22 downstream of the exhaust gas sensor 24. The exhaust gas purifier 28 may be in the form of a three-way catalytic converter which effects oxidation of HC and CO and reduction of NOx so as to minimize the emission of pollutants through the exhaust duct 22. The catalytic converter exhibits its maximum performance above a temperature. In view of this, it is preferable to maintain the catalytic converter at elevated temperature.

An exhaust gas recirculation (EGR) passage 30 is provided which has its one end opening into the second exhaust passage 20*b* and the other end thereof opening into the second intake passage 16*b*. The EGR passage 30 has therein an EGR valve 32 which opens to permit recirculation of exhaust gases from the second exhaust passage 20*b* into the second intake passage 16*b* so as to minimize pumping losses in the second cylinder unit including the cylinders D, E and F during a split engine mode where the engine operates on only the first cylinder unit including the cylinders A, B and C. The EGR valve 32 closes to prevent exhaust gas recirculation during a full engine mode where the engine operates on all of the cylinders A to F.

The EGR valve 32 is driven by a pneumatic valve actuator 34 which includes a diaphragm spreaded within a casing to define therewith two chambers on the opposite sides of the diaphragm, and an operating rod having its one end centrally fixed to the diaphragm and the other end thereof drivingly connected to the EGR valve 30. The working chamber 34*a* is connected to the outlet of a three-way solenoid valve 36 which has an atmosphere inlet communicated with atmospheric air and a vacuum inlet connected to the second intake passage 16*b*. The solenoid valve 36 is normally in a position providing communication of atmospheric pressure to the valve actuator working chamber 34*a* so as to close the EGR valve 32. During a split engine mode, the solenoid valve 36 receives a control signal from the control circuit 26 and moves to another position to introduce a vacuum to the valve actuator working chamber 34*a*, thereby opening the EGR valve 32.

Figure 2:
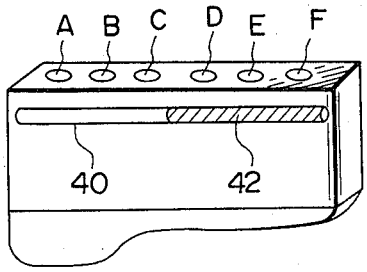
FIG. 2 is a schematic perspective view showing a significant portion of the internal combustion engine of FIG. 1.
Figure 3:
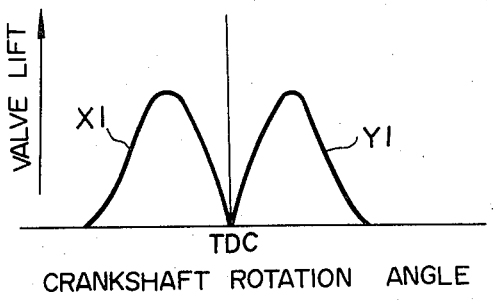
FIG. 3 is a graph showing valve overlap between the intake and exhaust valves associated with the first cylinder unit.
Figure 4:
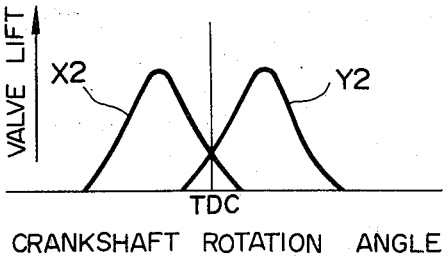
FIG. 4 is a graph showing valve overlap between the intake and exhaust valves associated with the second cylinder unit.

As shown in schematic form in FIG. 2, the engine has different valve operating means 40 and 42 for operating the intake and exhaust valves associated with the first and second cylinder units with different valve overlap amounts. The first valve operating means 40 is adapted to operate the intake and exhaust valves for the cylinders A, B and C included in the first cylinder unit with relatively small valve overlap or zero valve overlap, as shown in FIG. 3, to ensure that stable combustion can be carried out in the cylinders, A, B and C under low load conditions. In FIG. 3, curve X1 represents exhaust valve lift variations with respect to crankshaft rotation angle and curve Y1 represents intake valve lift variation with respect to crankshaft rotation angle. The first valve overlap amount may be in the range of about −10° to 20°, preferably 0° to 10°. The second valve operating means 42 is adapted to operate the intake and exhaust valves for the cylinders A, B and C included in the second cylinder unit with relatively large valve overlap, as shown in FIG 4, to ensure that sufficient output power can be achieved under high load conditions. In FIG. 4, curve X2 represents exhaust valve lift variations with respect to crankshaft rotation angle and curve Y2 represents intake valve lift variation with resect to crankshaft rotation angle. The amount of valve overlap may be adjusted by the choice of configuration of the cams associated with the respective cylinders A to F. The second valve overlap amount may be in the range of about 20° to 80°, preferably about 30° to 40°.

With such a split type internal combustion engine as constructed in accordance with the present invention, highly stable combustion is achieved with very few amount of unburned gases in the cylinders during a split engine mode where the engine operates on only the cylinders A, B and C designed to have relatively small valve overlap, and sufficient output power is achieved during a full engine mode where the engine operates on the cylinders A, B and C and also the cylinders D, E and F designed to have relatively large valve overlap to improve scavenging efficiency.

While the present invention has been described in connection with a six-cylinder internal combustion engine, it is to be noted that the particular engine shown is only for illustrative purposes and the structure of this invention could be readily applied to any split engine structure including V-type engines. In addition, while the present invention has been described in connection with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An internal combustion engine including first and second cylinder units each having at least one cylinder, first intake and exhaust valve means associated with said first cylinder unit, second intake and exhaust valve means associated with said second cylinder unit, and means for disabling said second cylinder unit when the engine load is below a predetermined value, said engine comprising:

(a) first valve operating means for operating said first intake and exhaust valve means with a first amount of valve overlap; and (b) second valve operating means for operating said second intake and exhaust valve means with a second amount of valve overlap relatively larger than said first valve overlap amount.

2. The internal combustion engine as set forth in claim 1, wherein said first valve overlap amount is in the range of about −10° to 20°.

3. The internal combustion engine as set forth in claim 1, wherein said second valve overlap amount is in the range of about 20° to 80°.

* * * * *